United States Patent [19]

Bruninga

[11] 4,205,788

[45] Jun. 3, 1980

[54] SPRINKLER HEAD WITH IMPROVED COMBINED STREAM COHERENCY DIFFUSER AND DISTANCE CONTROL BAFFLE MEMBER

[75] Inventor: Kenneth J. Bruninga, Mapleton, Ill.

[73] Assignee: L. R. Nelson Corporation, Peoria, Ill.

[21] Appl. No.: 959,619

[22] Filed: Nov. 13, 1978

[51] Int. Cl.[2] ..... B05B 3/14

[52] U.S. Cl. ..... 239/233; 239/510

[58] Field of Search ..... 239/230–233, 239/507–512

[56] References Cited

U.S. PATENT DOCUMENTS

| | | | |
|---|---|---|---|
| 2,775,485 | 12/1956 | Miller | 239/510 X |
| 2,816,798 | 12/1957 | Royer | 239/230 |
| 3,070,314 | 12/1962 | Warren | 239/233 X |
| 3,837,576 | 9/1974 | Rosenkranz | 239/230 |
| 4,000,853 | 1/1977 | Drori | 239/230 |

*Primary Examiner*—Robert B. Reeves
*Assistant Examiner*—Gene A. Church
*Attorney, Agent, or Firm*—Cushman, Darby & Cushman

[57] ABSTRACT

A step-by-step rotary sprinkler having a combined stream coherency diffuser and distance control baffle member formed of sheet metal to include an arm portion disposed generally vertically having an aperture extending horizontally through one end thereof, a baffle portion bent outwardly at generally right angles from the opposite end of the arm portion and a relatively small diffuser portion bent outwardly at right angles from the free edge of the baffle portion and a manual engaging tab also bent outwardly at right angles from the arm portion, and a pivot assembly extending through the aperture to mount the arm portion on the sprinkler body for pivotal movement into any desired position of adjustment within a predetermined range wherein the radially outermost point of the member is disposed radially inwardly of the radially outermost point of the drive spoon, the positions of adjustment within the range including (1) a diffused only position where the diffuser portion extends into the stream when the drive spoon is out of stream engagement dividing the same generally vertically so that the stream is spread horizontally without the same engaging the baffle portion and (2) a diffused and baffled position wherein both the diffuser portion and the baffle portion extend into the stream when the drive spoon is out of stream engagement so that the stream is both spread horizontally and deflected generally downwardly.

8 Claims, 4 Drawing Figures

SPRINKLER HEAD WITH IMPROVED COMBINED STREAM COHERENCY DIFFUSER AND DISTANCE CONTROL BAFFLE MEMBER

This invention relates to sprinklers and more particularly to improvements in step-by-step rotary impact sprinkler heads.

Step-by-step rotary impact sprinkler heads are well known and have achieved a high degree of acceptance as one of the most effective structures for distributing water onto an area to be sprinkled in an efficient manner. For purposes of varying the characteristic of the water stream and the water distribution pattern of such sprinkler heads, it is customary to provide either an adjusting pin operable to diffuse or break up the stream, and/or a baffle for engaging the stream and reducing the trajectory thereof so as to reduce the area thereof.

An example of a commercially available sprinkler head embodying an adjustable diffuser pin and an adjustable baffle is the Nelson BETA II sprinkler head manufactured by L. R. Nelson Corporation. Examples of diffuser pins and baffles disclosed in the patented literature are as follows: U.S. Pat. Nos. 1,798,488; 1,997,901; 2,816,798; 3,070,314; and 3,581,994.

One particular installation where the functions provided by an adjustable baffle and adjustable pin are desirable is in an underground system installed within a residential yard or the like where there is likely to be new seeding or delicate plants necessitating such stream and pattern variation. In underground systems of this type it is usual for the step-by-step rotary sprinkler head to be installed in an underground housing, the installation being such that when water under pressure is communicated with the particular sprinkler head, the latter will pop up from the underground housing and operate in an elevated or popped-up position. Where a step-by-step rotary sprinkler head must move vertically within an underground housing from a lowered storage position to a raised, popped-up position of operation, it is important to maintain the maximum radius of the sprinkler head structure to a minimum since minimization of the radius of the sprinkler structure enables the underground housing structure to be minimized. In commercial prior art situations where the sprinkler head is to be used as a pop-up sprinkler head, it has been the practice either to eliminate altogether the adjustable baffle which normally constitutes the outermost radial structure of the sprinkler head, or to replace the adjusting pin with a smaller baffle positioned in the location where the adjusting pin would normally be mounted.

It is an object of the present invention to provide a combined baffle and diffuser structure which provides the sprinkler with the ability to achieve the functional variations heretofore provided by both an adjustable diffuser pin and an adjustable baffle, while at the same time maintaining the reduced radial dimension heretofore provided in baffles of reduced size utilized to replace the diffuser pin as aforesaid.

In accordance with the principles of the present invention, this object is obtained by providing a combined stream coherency diffuser and distance control baffle member which includes an arm portion disposed generally vertically having an aperture extending horizontally through one end thereof, a baffle portion extending at generally right angles from the opposite end of the arm portion and a relatively small diffuser portion extending at generally right angles from the free edge of the baffle portion. The combined stream coherency diffuser and distance control baffle member is mounted on the sprinkler body by a pivot assembly extending through the aperture in the one end of the arm portion so as to enable the arm portion to be pivotally moved thereabout into any desired position of adjustment within a predetermined range wherein the radially outermost point of the combined member is disposed radially inwardly of the radially outermost point of the drive spoon. The positions of adjustment within the range include (1) a diffused only position wherein the diffuser portion extends into the stream when the drive spoon is out of stream engagement dividing the same generally vertically so that the stream is spread horizontally without the same engaging the baffle portion; and (2) a diffused and baffled position wherein both the diffuser portion and the baffle portion extend into the stream when the drive spoon is out of stream engagement so that the stream is both spread horizontally and deflected generally downwardly.

Preferably, the combined member of the present invention is stamped from sheet metal, the baffle portion and diffuser portion being bent in relation to the arm portion. Preferably a manual engaging tab is also provided as an integral bent portion of the sheet metal for enabling the member to be readily moved into any desired position of adjustment.

Accordingly, it is a further object of the present invention to provide a sprinkler head of the type described having an improved combined stream coherency diffuser and distance control baffle member which is simple in construction, economical to manufacture and effective in operation.

These and other objects of the present invention will become more apparent during the course of the following detailed description and appended claims.

The invention may best be understood with reference to the accompanying drawings wherein an illustrative embodiment is shown.

Figure 1:
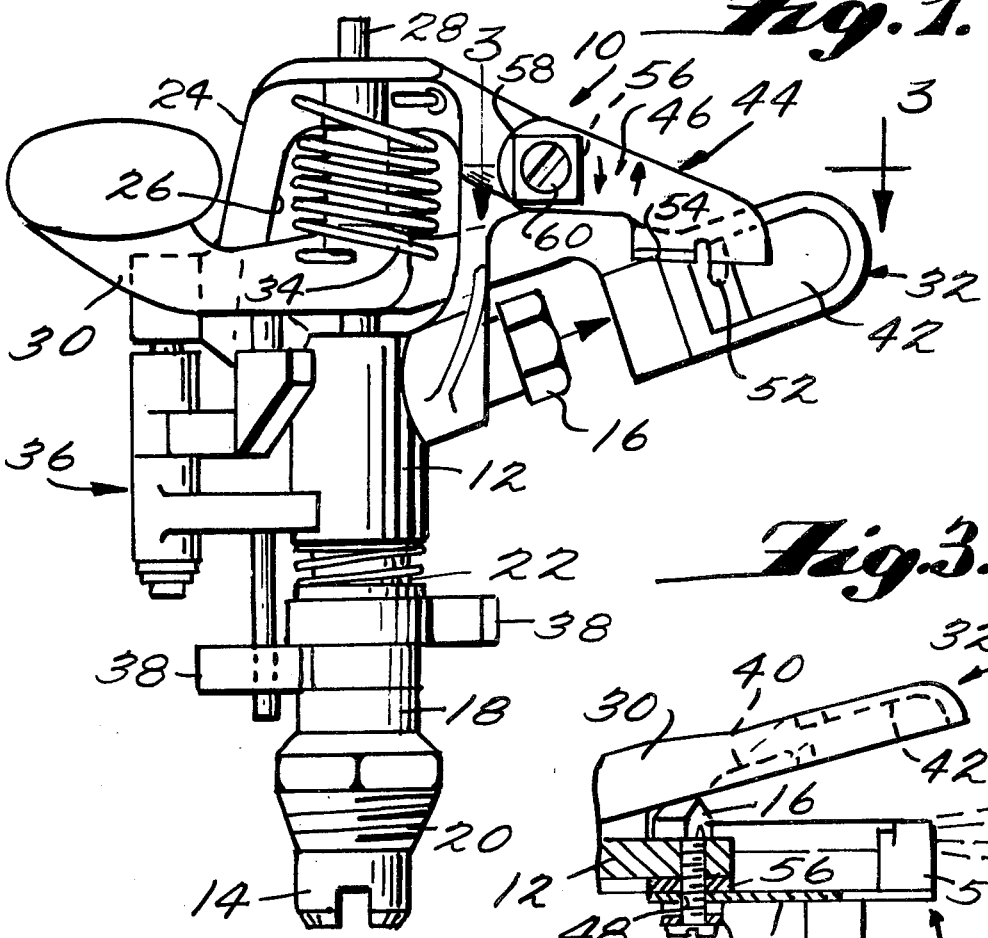
FIG. 1 is a side elevational view of a step-by-step rotary impact sprinkler head embodying the improved combined stream coherency diffuser and distance control baffle member of the present invention, showing the same in a diffused and baffled position.

Referring now more particularly to the drawings, there is shown therein a part circle step-by-step rotary sprinkler head, generally indicated at 10, which embodies the principles of the present invention. As shown, the sprinkler head 10 includes a main sprinkler body 12 cast of a suitable brass material. Connected with the lower portion of the sprinkler body 12 is a tubular member 14, the lower end of which constitutes an inlet for a flow passage extending upwardly through the sprinkler body 12 along a vertical axis of the lower tubular portion and then upwardly and outwardly through an outlet nozzle 16. Mounted for rotational movement about the vertical axis of the lower tubular portion 14 is a sleeve assembly 18. The lower portion of the sleeve assembly 18 has exterior threads 20 formed thereon adapted to engage the internal threads in a suitable source pipe (not shown). When the sleeve assembly 18 is connected with the source pipe by engagement of the threads 20 therewith the sprinkler body 12 is supported by the sleeve assembly 18 carried on the source pipe for rotational movement about a vertical axis. The sleeve assembly 18 has a spring pressed brake subassembly 22 associated therewith which serves to restrain the aforesaid rotational movement. It will also be understood that when the sprinkler head 10 is mounted on a suitable source pipe as by engagement of the threads 20 therewith and a source of water under pressure within the source pipe is communicated with the inlet 14, such water under pressure will flow upwardly through the sprinkler body 12 and then upwardly and outwardly through the outlet 16. It will be noted that the outlet 16 has a central longitudinal axis which is disposed within a vertical plane passing through the axis of rotation of the sprinkler body which intersects the vertical axis within such plane at an angle of approximately 25°.

Figure 3:
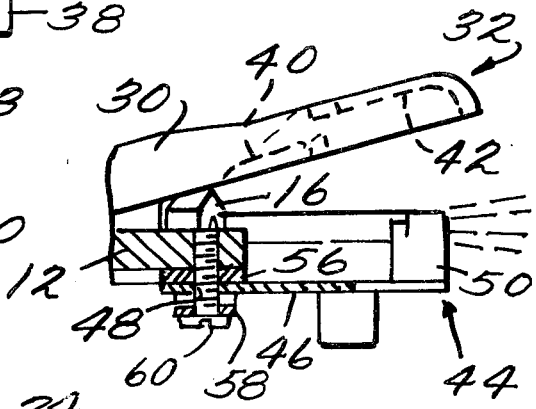
FIG. 3 is a fragmentary sectional view taken along the line 3—3 of FIG. 1 with the impact arm and drive spoon being shown in a position out of stream engagement.
Figure 2:
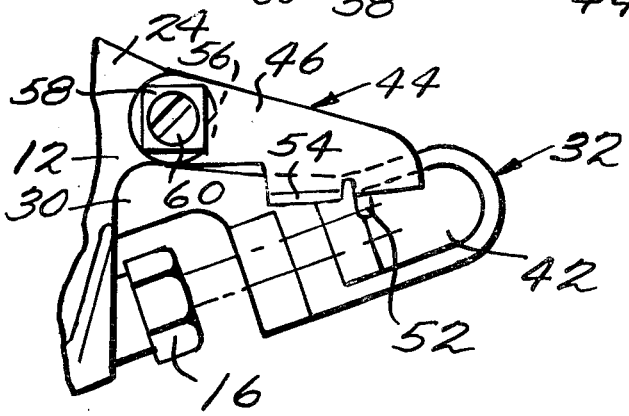
FIG. 2 is a fragmentary elevational view showing the improved combined stream coherency diffuser and distance control baffle member in a diffused position only.
Figure 4:
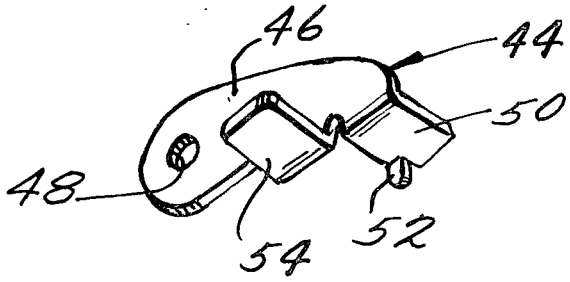
FIG. 4 is a perspective view of the combined stream coherency diffuser and distance control baffle member.

The sprinkler body includes an upper portion 24 having an opening 26 formed therein. Mounted in the upper portion of the sprinkler body 12 and extending through the opening 26 is a shaft 28 having its axis aligned with the vertical axis of rotation of the sprinkler body 12. Mounted on the shaft 28 for oscillatory pivotal movement is an impact arm 30. Formed integrally on one end of the arm 30 is a drive spoon, generally indicated by the numeral 32, which is constructed in accordance with the principles of the present invention. The impact arm 30 is normally biased into an impact limiting position, as shown in FIGS. 1–3, wherein the portions of the arm adjacent the shaft 28 engage the upper portion 24 of the sprinkler body on opposite sides of the opening 26. As shown, the bias is provided by a coil spring 34 surrounding the upper end of the shaft 28 and having one end connected with the upper portion of the sprinkler body and the other end thereof connected to the impact arm 30.

The drive spoon 32 is operable to be engaged by the stream when in its impact limiting position and to impart a pivotal or rotary movement to the arm 30 by virtue of the reaction of the water on the spoon in a direction to move the spoon away from the stream. As the arm rotates in a direction to move the spoon away from the stream, spring 34 retards its movement until it is completely stopped and resiliently biased thereby to move in the opposite direction. In this way as the arm rotates under the action of the spring 34 and moves into its impact limiting position, the upper portion 24 of the sprinkler body is impacted causing the sprinkler body 12 to move about its vertical pivotal axis under the restraint of spring brake 22. Thus, in accordance with usual practice, the impact arm and drive spoon will normally serve to effect a step-by-step rotational movement of the sprinkler body in one direction.

The sprinkler head 10 is provided with a reversing mechanism, generally indicated at 36, which is adapted to cooperate with the impact arm 30 and a pair of adjustable stops 38. The details of construction of the reversing mechanism and its exact mode of operation form no part of the present invention. An exemplary embodiment similar to the illustrative mechanism shown is disclosed in detail in U.S. Pat. No. 3,070,314, the disclosure of which is hereby incorporated by reference into the present specification. For present purposes, it is sufficient to note that in one position, the reversing mechanism is operable to permit the impact arm and drive spoon to function normally to effect a normal step-by-step rotational movement of the sprinkler body. When the sprinkler body reaches a first predetermined position as determined by the position of a first one of the adjustable stops 38, the reversing mechanism 36 is moved into a second position, which has the effect of causing the outward movement of the impact arm to effect a rapid step-by-step rotary movement of the sprinkler body in the opposite direction, until the latter reaches a second predetermined position of rotational movement determined by the position of adjustment of the other stop wherein the reversing mechanism 36 is moved back into its other operating position.

As shown in FIG. 1, the drive spoon 32 is of the conventional type and includes a radially inwardly disposed pull-in reactant surface 40 which is inclined in a direction to be initially engaged by the stream as the impact arm 30 moves toward its impact position so that the reaction force established by the stream on the pull-in reactant surface 40 acts in a direction to move the impact arm 30 toward its impact position. The drive spoon 32 also includes the usual drive-out reactant surface 42 which is disposed radially outwardly of the pull-in reactant surface 40 in a position to receive the water deflected from the pull-in reactant surface 40. The drive-out reactant surface 42 faces in a direction to establish a reaction force by the engagement of the stream therewith which acts in a direction to move the impact arm 30 away from the impact position.

The configuration of the drive spoon 32 with the pull-in reactant surface 40 and drive-out reactant surface 42 is of a conventional type which has been known for many years. The present invention is likewise applicable to anti-backsplash drive spoons of the type disclosed in my commonly assigned copending application Ser. No. 880,275 filed Feb. 22, 1978, now U.S. Pat. No. 4,164,324 issued Aug. 14, 1979 and the prior art patents mentioned therein.

The present invention is more particularly concerned with the provision of an improved combined stream coherency diffuser and distance control baffle member, generally indicated at 44. As shown, the member 44 is preferably stamped from sheet metal so as to include an arm portion 46 which, when mounted on the sprinkler body in the manner hereinafter more fully described, extends generally vertically and has an aperture 48 extending horizontally through one end portion thereof. A baffle portion 50 is bent outwardly so as to extend at generally right angles from the lower opposite end of the arm portion 48. A relatively small diffuser portion 52 is bent from the inner free edge of the baffle portion so as to extend at generally right angles therefrom in a generally downward vertical direction. In addition, a manual engaging tab 54 is bent from the central lower edge of the arm portion 44 so as to extend therefrom at right angles in a direction generally opposed to the direction of extent of the baffle portion 50.

As shown, the member 44 is mounted on the sprinkler body by suitable pivot means which extends through the opening 48. The pivot means includes an interior washer 56 which is disposed adjacent the sprinkler body at a position spaced vertically above the outlet nozzle 16. The pivot means also includes a spring clip member 58 and a pivot bolt 60. As shown, the bolt 60 extends through the spring clip 58, the opening 48 of the member 44, the washer 56 and is threadedly engaged within a bore in the adjacent portion of the sprinkler body 12. The washer, which is preferably made of polyethylene or the like, and the spring clip serve to grip the arm portion so as to yieldingly maintain the same in any desired position of pivotal movement into which it is moved.

It will be noted that the diffuser portion 52 is movable in response to the movement of the member 44 into different positions of adjustment within a vertical plane which intersects the axis of the outlet orifice of the outlet nozzle 16 and the pivotal or rotational axis of the sprinkler body 12. Moreover, the free edge of the baffle portion 50 moves in a vertical plane displaced horizontally from the latter.

With the conventionally shaped drive spoon 32 shown, the radially outward portion thereof includes sections which, when the drive spoon is in its impact position, extend beyond the vertical plane passing through the axis of the outlet orifice and the vertical axis of rotation in a horizontal direction opposite from that of the plane of movement of the free edge of the pivotal member. Consequently, the adjustment of the member 44 must be such that it is not moved into a position which will interfere with the movement of the drive spoon fully into its impact position. This interference problem would not be presented in an anti-backsplash type of drive spoon such as previously described.

As shown, the positions of adjustment of the member 44 include an uppermost inoperative position wherein both the diffuser portion 52 and baffle portion 50 are above the stream issuing from the outlet nozzle 16. Another position of adjustment is a diffused only position, such as shown in FIG. 2, where only the diffuser portion 52 extends into the stream when the drive spoon 32 is out of stream engagement, thus dividing the stream generally vertically so that the stream is spread horizontally without the same engaging the baffle portion 50. The member 44 is also movable into a diffused and baffled position such as shown in FIG. 1, where both the diffuser portion 52 and the baffle portion 50 extend into the stream issuing from the outlet nozzle 16 when the drive spoon is out of stream engagement, so that the stream is both spread horizontally and deflected generally downwardly.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A step-by-step rotary sprinkler comprising a sprinkler body having an inlet and an outlet, means for mounting said sprinkler body on a supply conduit having a source of water under pressure communicating therewith for controlled rotational movement about a vertical axis so that the water source flow into said inlet and issues from said outlet as a stream extending upwardly and outwardly, an impact arm mounted on said sprinkler body for water driven pivotal movement away from an impact position and biased pivotal movement toward said impact position, said impact arm having a drive spoon thereon including a pull-in reactant surface facing in a direction to be initially engaged by the stream as said arm moves toward said impact position so that the reaction force established by said stream acts in a direction to move said arm toward said impact position and a drive-out reactant surface disposed radially outwardly of said pull-in reactant surface in a position to receive the water deflected from said pull-in reactant surface and facing in a direction to establish a reaction force by the engagement of the stream therewith which acts in a direction to move said arm away from said impact position, a combined stream coherency diffuser and distance control baffle member including an arm portion disposed generally vertically having an aperture extending horizontally through one end thereof, a baffle portion extending at generally right angles from the opposite end of said arm portion and a relatively small diffuser portion extending at generally right angles from the free edge of said baffle portion, and pivot means extending through said aperture mounting said arm portion on said sprinkler body for pivotal movement thereabout into any desired position of adjustment within a predetermined range wherein the radially outermost point of said member is disposed radially inwardly of the radially outermost point of said drive spoon, the positions of adjustment within said range including (1) a diffused only position where said diffuser portion extends into the stream when said drive spoon is out of stream engagement dividing the same generally vertically so that the stream is spread horizontally without the same engaging said baffle portion and (2) a diffused and baffled position wherein both said diffuser portion and said baffle portion extend into the stream when said drive spoon is out of stream engagement so that the stream is both spread horizontally and deflected generally downwardly.

2. A sprinkler as defined in claim 1 wherein said combined member is formed of sheet metal.

3. A sprinkler as defined in claim 1 or 2 wherein said combined member also includes a manual engaging tab extending from said arm portion.

4. A sprinkler as defined in claim 3 wherein said manual engaging tab extends from said arm portion at a position between said opening and said baffle member in a direction generally opposed to the direction of extent of said baffle position.

5. A sprinkler as defined in claim 1 or 2 wherein said pivot means includes a headed bolt extending through said aperture and threadedly fixedly engaged within said sprinkler body.

6. A sprinkler as defined in claim 1 or 2 wherein said pivot means includes a washer surrounding said bolt between said arm portion and said sprinkler body.

7. A sprinkler as defined in claim 6 wherein said washer is made of plastic material.

8. A sprinkler as defined in claim 6 wherein said pivot means further includes a spring clip between the head of said bolt and said arm portion.

* * * * *